US007556765B2

(12) United States Patent
Zach et al.

(10) Patent No.: US 7,556,765 B2
(45) Date of Patent: Jul. 7, 2009

(54) TAPPING PIPE

(75) Inventors: Oliver Zach, St. Lorenzen (AT); Michael Klikovich, Hinterbrühl (AT); Michael Berger, Vienna (AT); Christian Rahm, Vienna (AT)

(73) Assignee: Refractory Intellectual Property GmbH & Co., KG, Vienna (AT)

( * ) Notice: Subject to any disclaimer, the term of this patent is extended or adjusted under 35 U.S.C. 154(b) by 140 days.

(21) Appl. No.: 11/568,160

(22) PCT Filed: Apr. 16, 2005

(86) PCT No.: PCT/EP2005/004051

§ 371 (c)(1),
(2), (4) Date: Nov. 16, 2006

(87) PCT Pub. No.: WO2005/118884

PCT Pub. Date: Dec. 15, 2005

(65) Prior Publication Data

US 2007/0164491 A1 Jul. 19, 2007

(30) Foreign Application Priority Data

Jun. 4, 2004 (DE) ..... 10 2004 027 440

(51) Int. Cl.
*C21C 5/42* (2006.01)

(52) U.S. Cl. ..... 266/45; 266/236; 222/591

(58) Field of Classification Search ..... 266/236, 266/45; 222/591, 590
See application file for complete search history.

(56) References Cited

U.S. PATENT DOCUMENTS

| | | | | |
|---|---|---|---|---|
| 5,310,164 | A * | 5/1994 | Rothfuss et al. | 266/45 |
| 6,346,212 | B1 | 2/2002 | Seo et al. | |
| 2007/0216073 | A1 * | 9/2007 | Pungersek et al. | 266/236 |

FOREIGN PATENT DOCUMENTS

| | | |
|---|---|---|
| DE | 1 984 685 U | 5/1968 |
| DE | 42 08 520 A1 | 9/1993 |
| DE | 198 21 981 A1 | 8/1999 |
| EP | 0 057 946 A1 | 8/1982 |

* cited by examiner

*Primary Examiner*—Scott Kastler
(74) *Attorney, Agent, or Firm*—Christopher L. Parmelee; Walker & Jocke LPA

(57) ABSTRACT

The present invention relates to a tapping pipe for a metallurgical melting vessel, such as a converter or an arc furnace.

9 Claims, 5 Drawing Sheets

TAPPING PIPE

The present invention relates to a tapping pipe (also called a tapping spout) for a metallurgical melting vessel. A metallurgical melting vessel is understood as an aggregate in which a metallurgical melt is produced, treated, and/or transported, such as a converter or arc furnace.

In this case, a molten metal located in the melting vessel is conducted along the tapping pipe into a downstream aggregate. For example, the steel from the converter is supplied via a ladle to a downstream continuous casting facility.

As much as possible, the molten metal is to be transported without contamination. For example, contact with the surrounding atmosphere (oxygen, nitrogen) is to be avoided, as is carrying along slag.

A converter tapping device is known from EP 0 057 946 B1, which comprises multiple refractory blocks or disks in the axial direction. The inlet-side block is to have a funnel-shaped passage channel (also called troughhole) and the passage channel of the tapping pipe is to have the smallest diameter at the outlet-side end. Tapping pipes designed in this way have been on the market for 20 years and have proven themselves.

Tapping pipes whose geometry at the outlet-side end corresponds to the requirements of DE 42 08 520 C2 have also proven themselves. In this case, the calculation of the outlet cross-section is based on a flow profile of the corresponding molten metal, assuming a mean value for the height of the molten metal above the tapping pipe.

For a converter tapping pipe, the height of the molten metal (bath height) during tapping is frequently nearly constant, because the converter is tilted (tracked) with increasing tapping time. However, the bath height is automatically reduced, particularly toward the end of tapping. The danger thus simultaneously increases that slag will be guided with the molten metal into the tapping pipe and through it. Furthermore, turbulence may form and a partial vacuum may occur in the tapping pipe. The danger of reoxidation and nitrogen pick-up increase simultaneously.

The present invention is based on the object of optimizing a tapping pipe of the type cited in such a way that it ensures the desired ("constant") mass flow over the entire tapping time and slag is prevented from being carried along. "Constant" means that, as much as possible, the mass flow in the tapping channel of the tapping pipe does not interrupt until the end of the tapping time. The absorption of oxygen or nitrogen is also to be avoided as much as possible. Finally, the tapping pipe is to be designed in such a way that the most uniform possible mass flow may be transported along the tapping pipe independently of its wear (within technically acceptable limits).

According to DE 42 08 520 C2, the flow profile of a molten metal may be determined from the following formula:

$$A(x)=m/(\rho*(2gx)^{1/2})$$

with

A(x)=required flow cross-section at distance x from bath level m=mass flow of the molten metal (the melt)

g=gravitational acceleration=9.81 m/s$^2$ x=selected distance from the bath level ρ=density of the molten metal (the melt)

In this case, only the cross-sectional change as a function of the fall height caused by the acceleration of the molten metal stream is taken into consideration. To ensure the clarity and comprehensibility of the calculations, influences such as viscosity of the molten metal or the wall friction are neglected and/or ignored both here and in the further calculations listed in this description.

For a specific molten metal, the required diameter of the flow channel at the outlet end may thus be determined exactly for a perpendicular position of the flow channel, a predefined flow quantity, and a predefined distance between bath level and outlet end. This is to be illustrated on the basis of an example:

m=700 kg/s x=2.7 m

ρ=7200 kg/m$^3$ (for steel)

$$A(x=2.7\text{ meters})=700/7200*(2*9.81*2.7)^{1/2}=0.01335\ \text{m}^2$$

From $A=d^{2*}\Pi/4$, for a tap having a circular cross-section at the outlet, the outlet diameter is calculated as $$d=(A*4/\Pi)^{1/2}$$

$$d=[(0.01335*4)/\Pi]^{1/2}=0.1304\text{ m}$$

Figure 1:
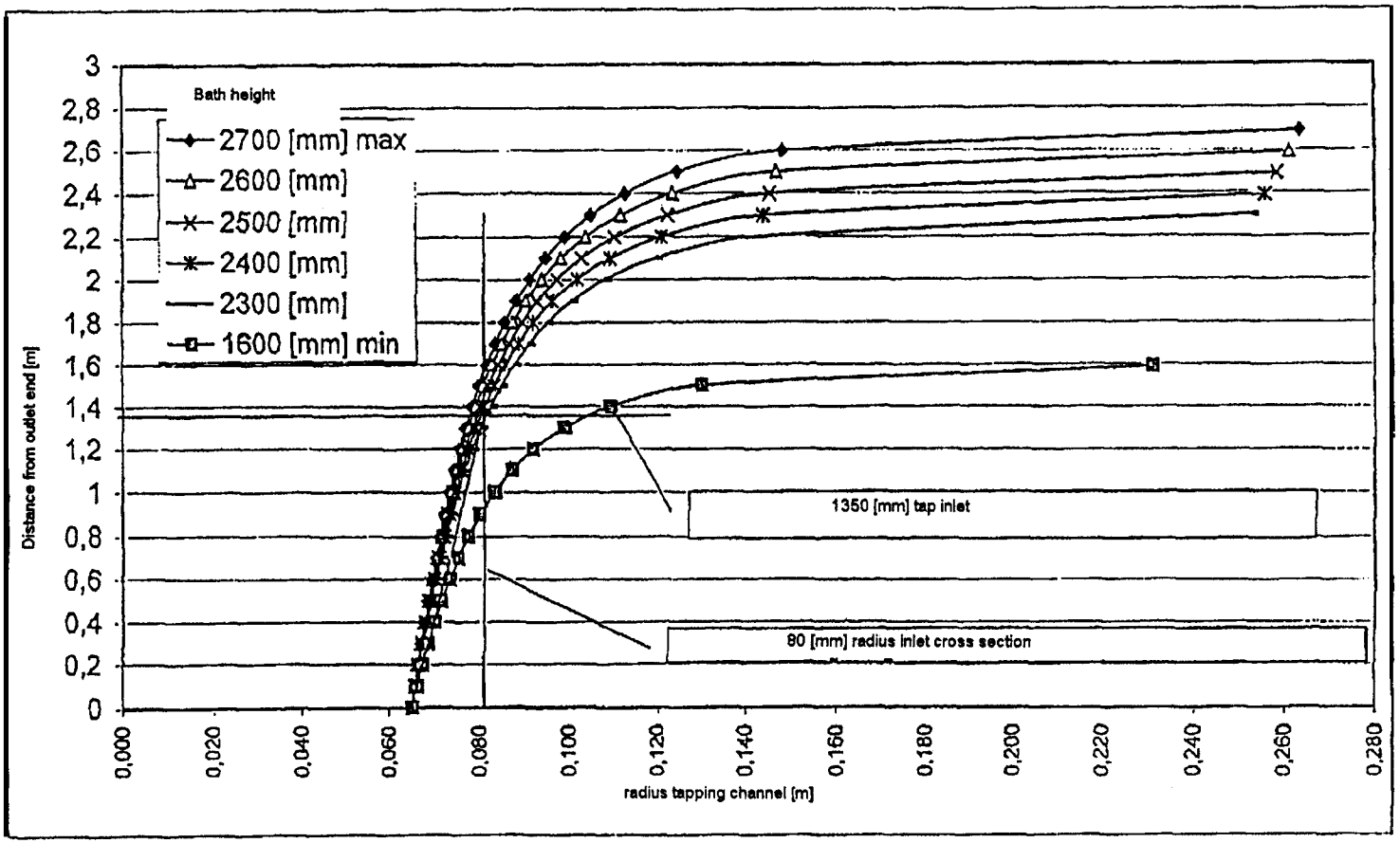
FIG. 1 shows examples for different bath heights as a function of the distance from the outlet end.

For a predefined diameter of the tapping channel at the outlet end, however, a decisive aspect for the flow quantity and the resulting flow profile is the particular bath height (height of the molten metal above the outlet end of the tapping pipe). The required radius of a circular cross-section of the flow channel of the tapping pipe is plotted in FIG. 1 as an example for different bath heights as a function of the distance from the outlet end, "0" defining the outlet end of the tapping pipe, 1.35 meters being the total length of the (novel) tapping pipe, and a maximum bath height of 2.70 meters being assumed (calculated from the outlet end). The effective maximum height of the molten metal bath above the tap inlet end is accordingly 1.35 meters. Using a predefined flow quantity as a basis, the illustrated curve shows the theoretical necessary minimum radius of the tapping channel (flow channel in the tapping pipe) for the maximum bath height (=2700 mm) at different distances from the outlet end beginning at a radius=65 mm at the outlet end. The remaining curves show the theoretical necessary minimum radius of the tapping channel at different distances from outlet end for different bath heights under the assumption of identical cross-section (radius 65 mm) at the outlet end.

It may be seen that at a bath height between 2700 mm and 2400 mm in the inlet region of the tapping pipe, a radius of 80 mm is sufficient for the cross-section of the flow channel in order to fill up a circular cross-section of the tapping pipe at the outlet end having a radius of 65 mm completely with the molten metal stream.

However, if the bath level falls further, to a minimum bath height of 1600 mm, for example, which is also shown (effective height of the molten metal bath above the tap inlet now: 250 mm), a value of approximately 110 mm results for the necessary radius of the cross-section of the flow channel in the inlet region of the tapping pipe for the same cross-section of the tapping pipe at the outlet end.

Only a bath level range of 30% to 70% is considered in DE 42 08 520 C2 for the design of the tapping geometry.

An inlet diameter of 75 mm results from DE 42 08 520 C2 for the above example considering a minimum bath level of 30% and a length of the worn tap (tapping device) of 750 mm. It may be concluded from this that the teaching of DE 42 08 520 C2 results in tapping pipes whose passage channel is too small at the inlet end.

In contrast, the present invention results in completely different geometries of the passage channel of a tapping pipe.

By considering low bath heights (effective height of the molten metal above the inlet region of the tapping pipe: <30% of the maximum value), the required cross-section at the inlet end becomes larger and deviates significantly from the cross-section which would result according to DE 42 08 520 C2.

Figure 2:
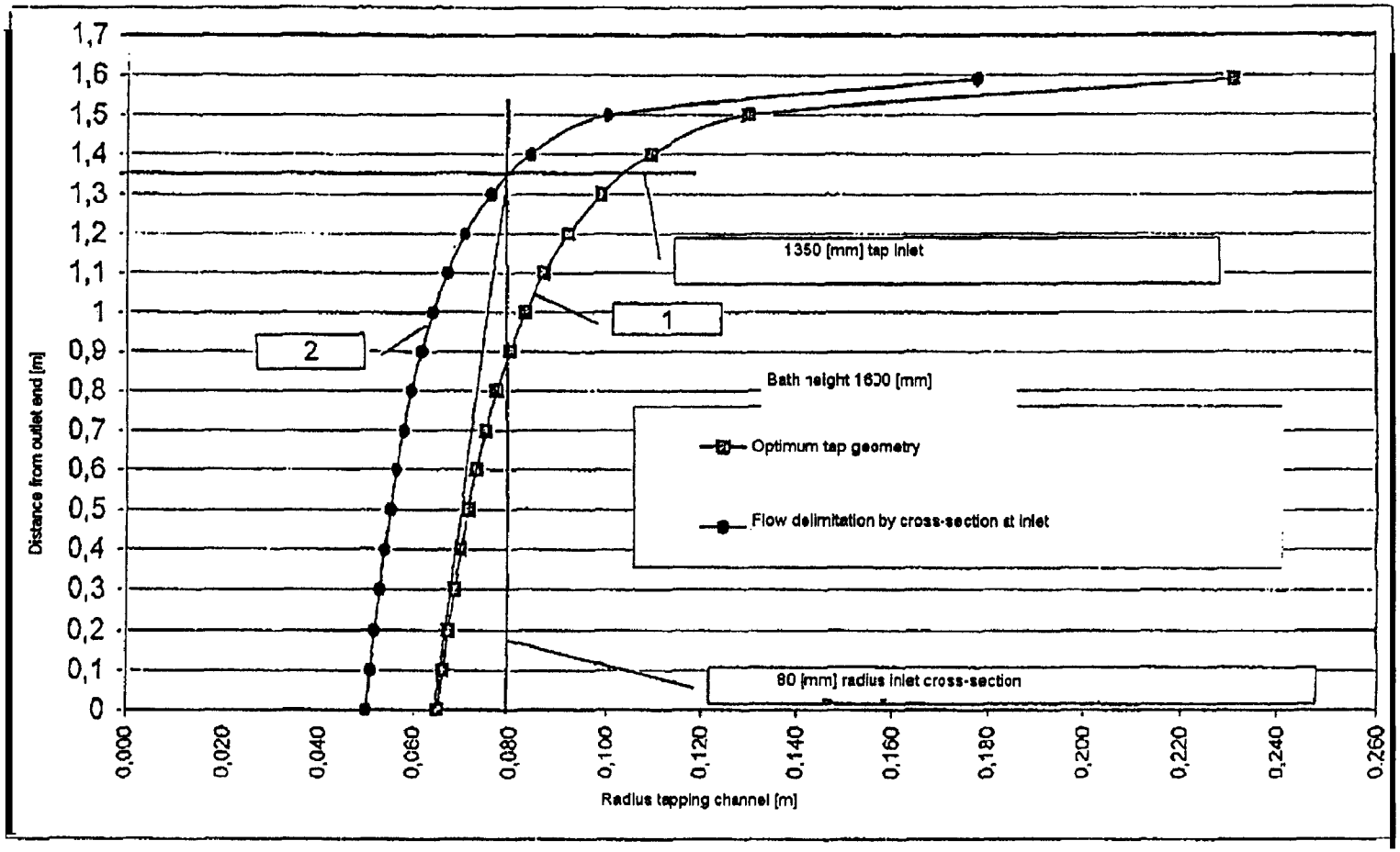
FIG. 2 shows a profile of the outlet channel in longitudinal section and the flow conditions in a tapping pipe according to the invention (curve 1) and according to the related art (curve 2).

In FIG. 2, curve (1) once again shows the required profile of the outlet channel in longitudinal section (theoretical necessary minimum radius) at a bath height of 1600 mm and a radius of the outlet cross-section of 65 mm. Curve (2) shows the flow conditions in a tapping pipe according to the related art (radius of the inlet cross-section: 80 mm). A stronger constriction of the stream in the tapping pipe results in the related art because of the inlet cross-section, which is too small in comparison to the inlet cross-section required according to the present invention (radius=110 mm). If the stream is formed freely, this only corresponds to radius of the cross-sectional area of 50 mm at the outlet end. Therefore, it is no longer possible in the region below the inlet cross-section to fill out the entire cross-section of the tapping channel and use it for the melt to run out. The results are the mentioned turbulences and partial vacuums in the tapping pipe, with the danger that slag floating on the molten metal will be carried along. Simultaneously, the turbulences arising along the pipe path result in a (further) reduction of the volume flow quantity and therefore the tapping time becomes longer than necessary. This results in a reduction of the temperature of the molten metal. This makes it necessary to heat the molten metal to the desired temperature level again in the following treatment steps, causing additional energy costs.

Avoiding turbulence and maintaining a compact stream in the tapping channel is achieved according to the present invention by a design of the tapping channel in which the entire tapping channel is completely filled with molten metal during the entire tapping time, i.e., even at low bath heights (effective height of the bath level above the inlet end of the tapping pipe: less than 30% of the maximum height).

In its most general embodiment, the present invention comprises a tapping pipe for a metallurgical melting vessel, whose axially running passage channel has a channel cross-section A(y) between the outlet end and the inlet end having the following dependence:

$$A(y) = A * \sqrt{((h_1 + h_k)/(h_1 + h_k - y))}$$

with

A=cross-sectional area at the outlet end [$m^2$]

$h_1$=effective height of the molten metal bath above the inlet end [m]—in axial extension of the tapping channel $h_k$=length of the tapping pipe between inlet end and outlet end [m]

y=axial distance [m] between the outlet end and a point along the tapping pipe with $0 \leqq y \leqq (h_1+h_k)$.

"$h_1$" may be less than or equal to 0.3 times the maximum height ($h_{max}$) of a molten metal in the melting vessel in axial extension of the tapping pipe. The variable factor ($h_1/h_{max}$) considers the different flow behaviors, particularly at low bath height. It results from the factor "≦0.3" that in this case a state is registered in which the effective height of the molten metal level above the inlet end of the tapping pipe is at least 70% less than the effective height of the molten metal level at the maximum bath height.

"$h_k$" indicates the particular length of the tapping pipe between inlet end and outlet end. While the outlet end of the tapping pipe is automatically its lower free end and remains unchanged over time, the position of the inlet end changes with the duration of usage of the tapping pipe. Wear of the refractory material on the inlet end is responsible for this. As defined, the inlet end corresponds to the level of the neighboring refractory material of a refractory lining of the metallurgical melting vessel. The length of the tapping pipe is accordingly shortened with increasing erosion.

Finally "y" identifies the axial distance between the outlet end and a point along the tapping pipe. For the outlet end, y=0, so that the following results from the preceding formula:

$$A_{(y=0)}=A$$

The following dependence results for the diameter $d_{(y)}$ of the tapping cross-section between outlet end and inlet end as a special case of a circular tapping cross-section:

$$d(y) = d * \sqrt[4]{((h_1 + h_k)/(h_1 + h_k - y))}$$

with d=diameter at the outlet end $h_1$=0.3 $h_{max}$ or less of the maximum height ($h_{max}$) of the molten metal in the melting vessel above the tapping inlet in axial extension of the tapping pipe, $h_k$=length of the tapping pipe between inlet end and outlet end, y=axial distance between the outlet end and a point along the tapping pipe.

In this case, "d" describes the diameter at the outlet end with a predefined desired flow quantity predefined. The higher the desired volume flow quantity is, the larger is the diameter "d".

In the following, the teaching according to the present invention will be explained on the basis of different exemplary embodiments. The length of the tapping pipe ($h_k$) is assumed to be 1.35 meters, the height of the bath level ($h_1$)—from the inlet end of the pipe—is assumed to be 0.25 meters (=18.5% of the maximum height of the molten metal bath of 1.35 meters above the tapping inlet). The diameter "d" at the outlet end was fixed at 0.13 meters in order to ensure a desired volume flow quantity "X".

Using the above-mentioned formula, the internal diameter of the passage channel at the inlet may be calculated as follows:

$$d_{(y)} = 0.13 * \sqrt[4]{((0.25 + 1.35)/(0.25 + 1.35 - 1.35))} = 0.21 \text{ m}$$

At a distance of 1 meter to the outlet end, the following diameter value results for the passage channel:

$$d_{(y)} = 0.13 * \sqrt[4]{((0.25 + 1.35)/(0.25 + 1.35 - 1.0))} = 0.17\,\text{m}$$

while at the outlet—as noted—$d_{(y)}$=d, i.e., 0.13 m.

Using a pipe length of 2.0 meters as a basis (with otherwise unchanged framework data such as outlet cross-section, outlet diameter, effective height of the bath level above the inlet end), the required diameter at the inlet end results as 0.23 meters, that at a distance of 1 meter to the outlet as 0.15 meters, while that at the outlet end remains unchanged at 0.13 meters.

It may be deducted from this that with increasing length of the tapping pipe, the required opening width of the inlet end becomes larger.

Alternatively, if the above calculations are performed for a pipe length of 1.35 meters and a diameter at the outlet end of 0.13 meters with an effective height of the molten metal level above the inlet end of 0.4 meters (corresponding to approximately 30% of the maximum bath height), the diameter of the flow channel at the inlet region is calculated at 0.19 meters and that at 1 meter height to the outlet end is calculated at 0.16 meters.

According to one embodiment, the factor ($h_1/h_{max}$) is assumed to be >0.05 and/or <0.3 ($h_{max}$ is the maximum height of the molten metal in the melting vessel above the inlet region of the tapping pipe in axial extension of the tapping pipe). According to a further embodiment, the value is between >0.1 and/or <0.2.

As noted, the dimensioning of the tapping pipe in the inlet-side part is important above all. In this case, above all the ratios at low effective heights of the bath level (<30% of the maximum effective height of the bath level above the inlet end) are decisive. The cross-sectional geometry at the outlet-side end is predominantly determined by the predetermined value of the volume flow quantity (mass flow at maximum bath height).

According to one embodiment, the cross-sectional calculation for the flow channel therefore relates to values "y" >50% of the total length of the tapping pipe. According to a further embodiment, these values are increased to ranges >70%. This means that essentially 50% or one third of the total length of the pipe is to be designed according to the present invention (starting from the inlet end).

Figure 3:
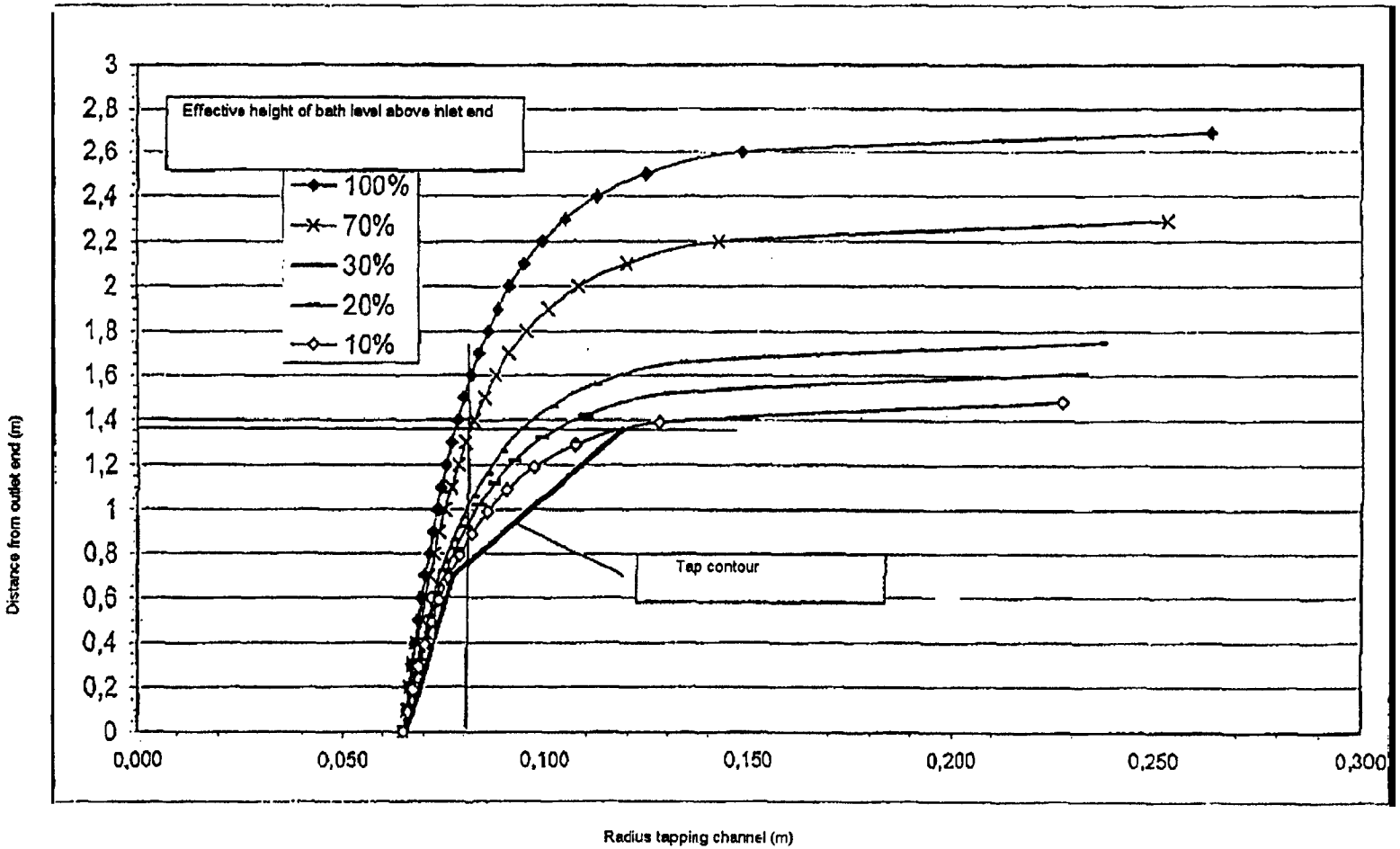
FIGS. 3-5 show examples of profiles according to the invention.
Figure 4:
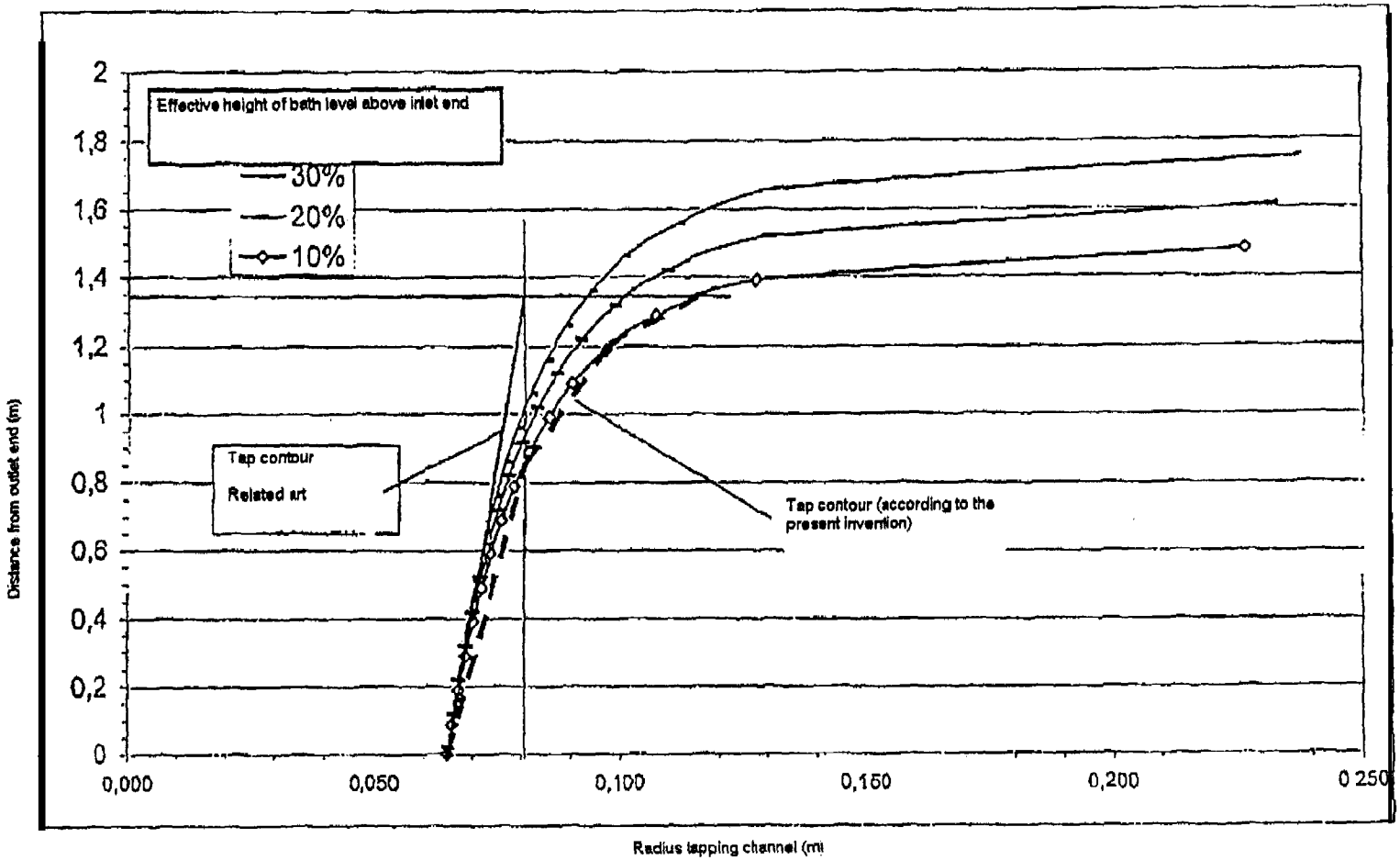
Figure 5:
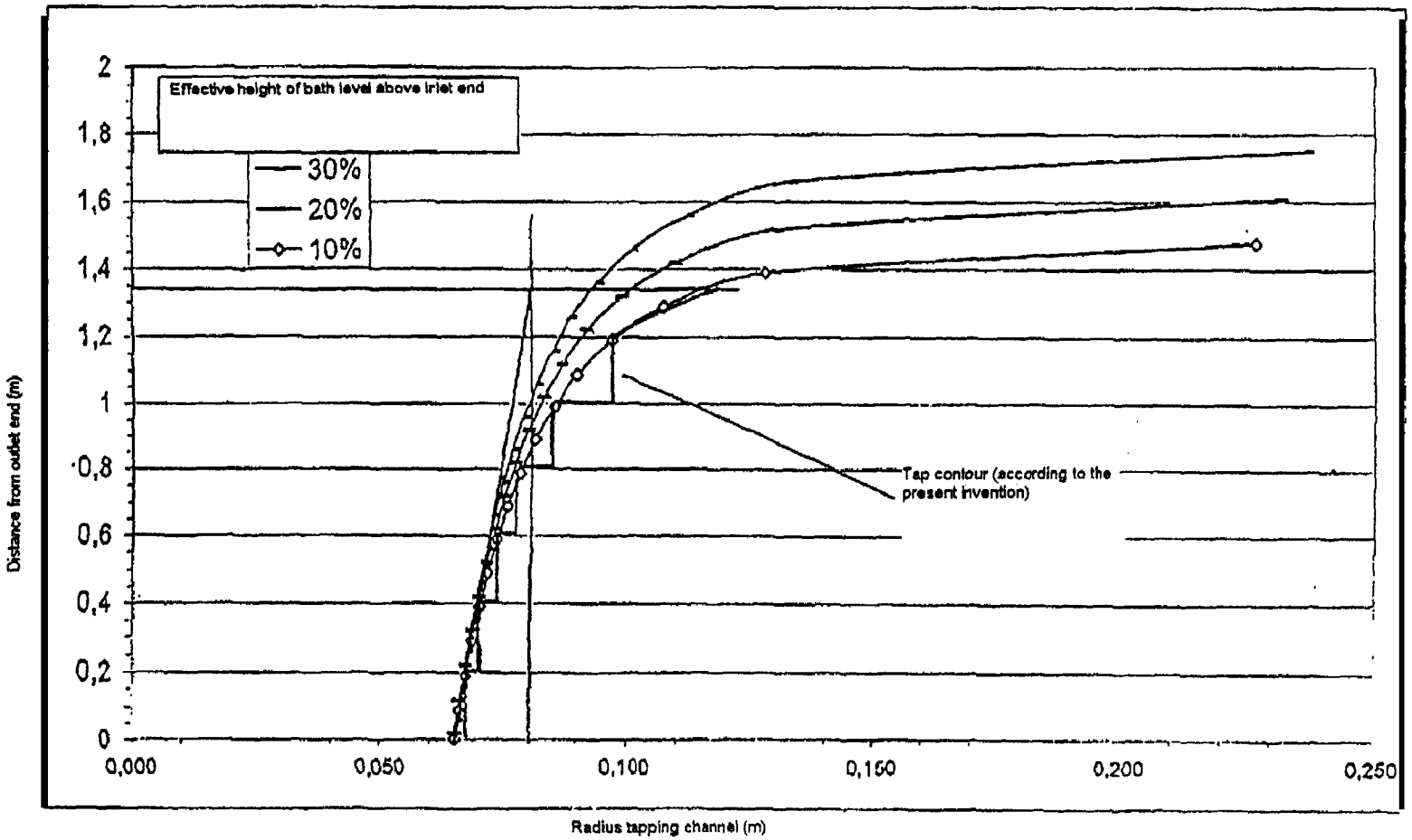

This section may be implemented as conically tapering continuously; the necessary taper in the direction to the outlet-side end may also occur in steps if necessary. Adaptation to the optimum geometry of the flow channel in the form of polygonal draft (see FIGS. 3 through 5) or arched sections is also possible (viewed in longitudinal section). In addition to the ideal geometries calculated according to the present invention, stepped wall courses technically adapted thereto are also shown in FIGS. 3-5, realizing the desired effects as well and which are easier to manufacture.

Particularly the lower outlet-side half of the tapping pipe may follow the conicity of the (upper) inlet-side part; however, it is also possible to implement this part with less conicity (slope), up to a cylindrical shape of the flow channel. This particularly applies for the last 10 to 20% of the length of the tapping pipe at the outlet side.

Regarding the slope of the flow channel, the present invention provides the teaching, according to one embodiment (circular channel cross-section and symmetrical implementation of the internal contour to the channel axis), of designing the wall region in such a way that the slope (S) of the internal contour of the flow channel (in longitudinal section) follows the following dependence:

$$S = r/4 * \sqrt[4]{((h_1 + h_k)/(h_1 + h_k - y)^5)}$$

with r=radius of the channel cross-section at the outlet end.

In this case, the slope S describes the change of the radius $r_{(y)}$ of a circular cross-section of the tapping channel as a function of the distance y to the outlet end of the tap.

For example, the values listed in the following table thus result for different effective bath heights for the minimum required slope S at different distances from the outlet end of the tapping pipe with

| | $h_k$ = 1.35 m<br>$h_{max}$ = 1.35 m<br>r = 0.065 m | | | | | |
|---|---|---|---|---|---|---|
| Effective bath height | 0.3 * $h_{max}$ = 0.405 m | | 0.2 * $h_{max}$ = 0.27 m | | 0.1 * $h_{max}$ = 0.135 m | |
| Distance from outlet end | 0.5 * $h_k$ = 0.675 m | 0.7 * $h_k$ = 0.945 m | 0.5 * $h_k$ = 0.675 m | 0.7 * $h_k$ = 0.945 m | 0.5 * $h_k$ = 0.675 m | 0.7 * $h_k$ = 0.945 m |
| S | 0.017 | 0.0243 | 0.0197 | 0.03 | 0.0233 | 0.0383 |

with $S_{A(y)}$=change of the cross-section in $m^2/m$ at the point y

| $h_k$ = 2.0 m<br>$h_{max}$ = 1.35 m<br>r = 0.065 m | | | | | | |
|---|---|---|---|---|---|---|
| Effective bath height | 0.3 * $h_{max}$ = 0.405 m | | 0.2 * $h_{max}$ = 0.27 m | | 0.1 * $h_{max}$ = 0.135 m | |
| Distance from outlet end | 0.5 * $h_k$ = 1.0 m | 0.7 * $h_k$ = 1.4 m | 0.5 * $h_k$ = 1.0 m | 0.7 * $h_k$ = 1.4 m | 0.5 * $h_k$ = 1.0 m | 0.7 * $h_k$ = 1.4 m |
| S | 0.0132 | 0.0201 | 0.0148 | 0.0237 | 0.0168 | 0.0289 |

with

| $h_k$ = 0.75 m (e.g., reduced tapping length with worn converter lining)<br>$h_{max}$ = 1.95 m<br>r = 0.065 m | | | | | | |
|---|---|---|---|---|---|---|
| Effective bath height | 0.3 * $h_{max}$ = 0.585 m | | 0.2 * $h_{max}$ = 0.39 m | | 0.1 * $h_{max}$ = 0.195 m | |
| Distance from outlet end | 0.5 * $h_k$ = 0.375 m | 0.7 * $h_k$ = 0.525 m | 0.5 * $h_k$ = 0.375 m | 0.7 * $h_k$ = 0.525 m | 0.5 * $h_k$ = 0.375 m | 0.7 * $h_k$ = 0.525 m |
| S | 0.0184 | 0.0227 | 0.0235 | 0.0308 | 0.0324 | 0.0474 |

The examples show that in the inlet-side region (first third of the channel length), the values are to be ≧0.02 for the slope S. At very low effective bath heights and shorter lengths of the tapping spout, the region in which S is to be ≧0.02 extends to the inlet-side half of the tapping channel. This value S may be increased to ≧0.025, ≧0.05, or ≧0.25.

This applies at least for the upper half (neighboring the inlet end) and/or the upper third (neighboring the inlet end) of the tapping channel, but may also extend over the entire length of the tapping channel. Directly at the inlet end (over a length of 0.05 of the total length of the tapping pipe), the value may be >>0.25, for example, 1, 5, 10, 30, 50, 70, or 100. If the wall design of the tapping channel is completely or partially stepped or if the design is adapted to the production facilities, "slope" indicates the slope of a straight connecting line which may be plotted between the edges of sequential steps in longitudinal section.

The dimensioning of a tapping pipe according to the present invention also considers the length change of the tapping pipe as a function of the wear of the neighboring lining, in that the particular values for the tapping spout length and height of the melt thereabove are included in the calculation.

If one observes the change of the cross-section of the passage channel along the axis from the outlet end to the inlet end under idealized flow conditions and standardizes this change to the cross-section, the following equation results:

$$S_{A(y)}/A = 1/2\sqrt{((h_1 + h_k)/(h_1 + h_k - y)^5)}$$

with

A=cross-sectional area of the passage channel at the outlet end of the tapping pipe $h_1$=0.3 $h_{max}$ or less of the maximum height ($h_{max}$) of a molten metal in the melting vessel above the tapping inlet in axial extension of the tapping pipe, $h_k$=length of the tapping pipe between inlet end and outlet end, y=axial distance between the outlet end and a point along the tapping pipe.

With the following assumption: molten metal level at most 30% of the maximum effective bath height above the inlet end of the tapping channel, the following value results for the inlet-side half of the tapping channel:

$$S_{A(y)}/A \geq 1/2 \cdot \sqrt{(2.4)/2.4 - 1)^3}$$

$$S_{A(y)}/A \geqq 0.468[1/m]$$

with $h_k$=2 m $h_1$=0.4 m y=1 m

This means that in the inlet-side half of the tapping channel, the cross-sectional area must increased by at least 47% per meter of channel length in order to provide favorable flow conditions.

The design of the tapping pipe according to the present invention allows the tapping procedure to be operated even at low bath heights with reduced turbulence and a constant molten metal stream and thus significantly reduce the carry-over of slag. In addition, due to the reduction of the temperature losses and the reduced wear, further economic advantages result, such as energy savings and extended service life of the tap.

What is claimed is:

1. An apparatus comprising:

a metallurgical melting vessel adapted to hold a molten metal bath therein;

a tapping pipe in operative connection with the metallurgical melting vessel, wherein the tapping pipe includes an inlet end, an outlet end, and an axially running passage channel between the inlet end and the outlet end, wherein the axially running passage channel has a cross-section between the inlet end and the outlet end which follows the following dependency:

$$A_{(y)}=A*\sqrt{(h_1+h_k)/[(h_1+h_k)-y]}$$

with

A=cross-sectional area of the passage channel at the outlet end in $m^2$ (with a desired volume flow quantity predefined), $h_1$=effective height of the molten metal bath in the metallurgical melting vessel above the inlet end of the tapping pipe (in axial extension of the tapping channel) [m] (with $h_1 \leqq 0.2h_{max}$), $h_{max}$=maximum height that the metallurgical melting vessel is capable of holding the molten metal bath therein above the inlet end of the tapping pipe [m] (in axial extension of the tapping pipe), $h_k$=length of the tapping pipe between the inlet end and the outlet end [m], and Y=axial distance [m] between the outlet end and a point along the tapping pipe (with $0<y\leqq(h_1+h_k)$).

2. The apparatus according to claim 1, with $h_1>0.05\ h_{max}$.

3. The apparatus according to claim 2, with $h_1>0.1\ h_{max}$ and$<0.2\ h_{max}$.

4. The apparatus according to claim 1, with $y>0.5\ h_k$.

5. The apparatus according to claim 1, with $y>0.7\ h_k$.

6. The apparatus according to claim 1, with a circular cross-section of the axial running passage channel.

7. The apparatus according to claim 1, wherein a section of the axial running passage channel neighboring the outlet end is shaped cylindrically.

8. A method of making a tapping pipe for a metallurgical melting vessel, wherein the tapping pipe includes an inlet end, an outlet end, and an axially running passage channel between the inlet end and the outlet end, wherein the metallurgical melting vessel is operative to hold a molten metal bath therein at a maximum height of $h_{max}$ [m] above the inlet end of the tapping pipe (in axial extension of the tapping pipe), wherein the tapping pipe has a cross-sectional area of the axially running passage channel at the outlet end in $m^2$ (with a desired volume flow quantity predefined) of A, wherein the tapping pipe has a length between the inlet end and the outlet end of $h_k$ [m], wherein the method comprises:

a) determining a shape for the axially running passage channel having a cross-section between the inlet end and the outlet end which follows the following dependency:

$$A_{(y)}=A*\sqrt{(h_1+h_k)/[(h_1+h_k)-y]}$$

with

A=cross-sectional area of the axially running passage channel at the outlet end in $m^2$ (with a desired volume flow quantity predefined), $h_1$=effective height of the molten metal bath in the metallurgical melting vessel above the inlet end of the tapping pipe (in axial extension of the tapping channel) [m] (with $h_1 \leqq 0.2h_{max}$), y=axial distance between the outlet end and a point along the tapping pipe (with $0<y\leqq(h_1+h_k)$); and b) producing the tapping pipe with the axially running passage of the tapping pipe corresponding to the shape determined in (a).

9. The method according to claim 8, wherein in (a), $y>0.5\ h_k$.

* * * * *